United States Patent [19]

Sparkes et al.

[11] Patent Number: 4,694,773

[45] Date of Patent: Sep. 22, 1987

[54] REMOTE CONTROL TILTING SYSTEM FOR RAISING AND LOWERING RADAR AND RADIO ARCH FOR BOATS

[75] Inventors: Laurie R. Sparkes; Joseph G. Baker, both of Richmond, Va.

[73] Assignee: JGB Industries, Inc., Richmond, Va.

[21] Appl. No.: 837,281

[22] Filed: Mar. 7, 1986

[51] Int. Cl.[4] ..... H01Q 1/32

[52] U.S. Cl. ..... 114/354; 343/709; 343/880

[58] Field of Search ..... 114/343, 354, 272, 273, 114/288, 202; 441/11, 36; 343/710, 709, 705, 708, 711, 712, 713, 878, 880, 881, 882

[56] References Cited

U.S. PATENT DOCUMENTS

| | | | |
|---|---|---|---|
| 1,306,145 | 6/1919 | Hammond | 343/881 |
| 2,367,164 | 1/1945 | Yerger | 343/714 |
| 2,531,215 | 11/1950 | Harmon | 343/880 |
| 4,101,897 | 7/1978 | Morrison | 343/881 |
| 4,185,288 | 1/1980 | Dosch | 343/880 |

*Primary Examiner*—Joseph F. Peters, Jr.

*Assistant Examiner*—Clifford T. Bartz

*Attorney, Agent, or Firm*—Mason, Fenwick & Lawrence

[57] ABSTRACT

A tiltable upwardly extending supporting arch assembly for supporting a radar antenna and other antenna devices above the roof of a cabin or control bridge superstructure of a boat including a unitary rigid arch member of inverted substantially U-shaped configuration having a generally horizontal transversely elongated top portion and a pair of depending leg portions having feet at their lower ends. The feet are attached to a pair of tilting base mounting assemblies each having a base housing component in the shape of an elongated box shaped housing to be fixed to the roof and having a tiltable top plate member pivoted to the box-shaped housing for movement from a first position disposing the arch member in a raised normal operating position to a second position disposing the arch member in a lower position wherein the leg portions lie substantially parallel to the roof. Powered actuator means in the box-shaped housing controlled by a toggle switch move the top plate member between the first and second portion.

15 Claims, 7 Drawing Figures

FIG-6
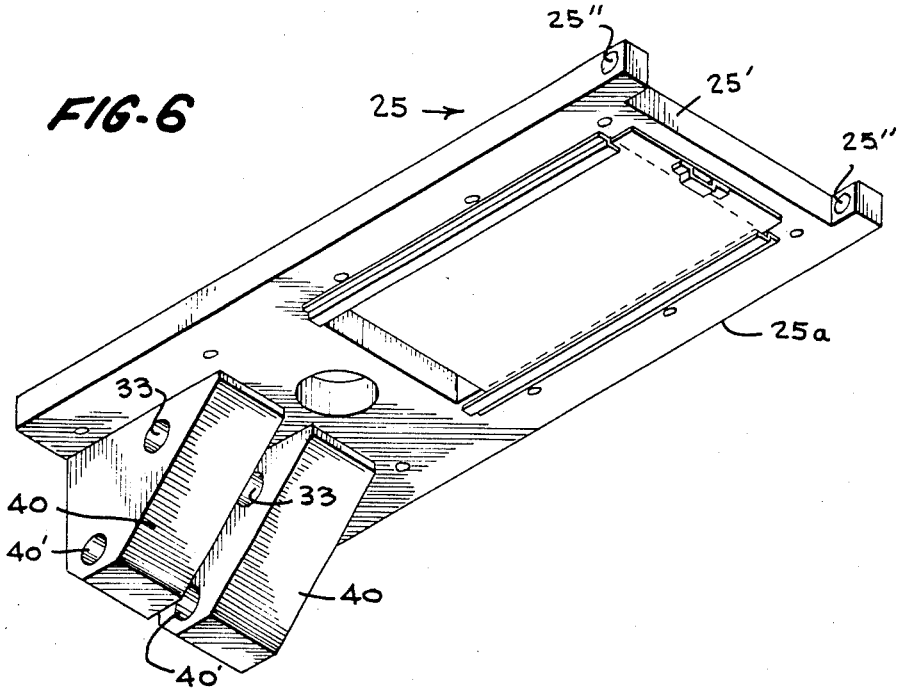
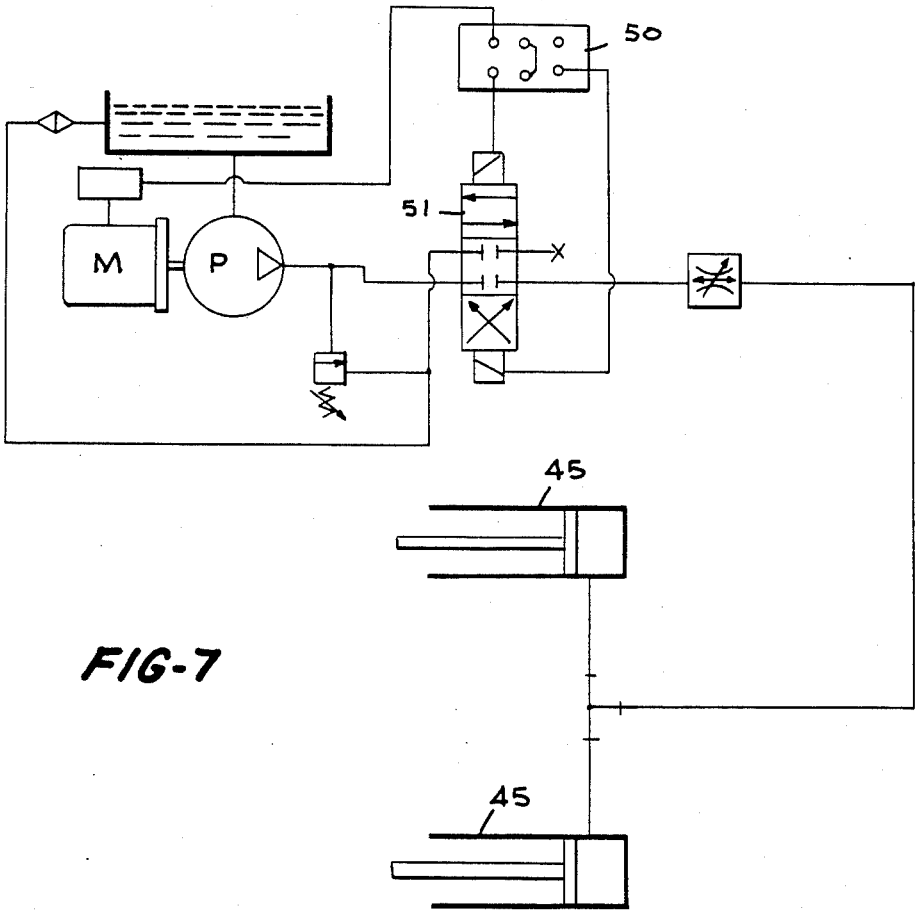
FIG-7

REMOTE CONTROL TILTING SYSTEM FOR RAISING AND LOWERING RADAR AND RADIO ARCH FOR BOATS

BACKGROUND AND OBJECTS OF THE INVENTION

The present invention relates in general to a tiltable upwardly extending supporting bridge or arch mechanism for marine electronic equipment such as a radar antenna, elongated marine radio antennas and the like, and more particularly to a tiltable radar antenna and supporting arch assembly for boats having super structures such as cabin, piloting bridge or the like extending above the normal deck level, as on cabin cruisers or the like, for supporting a radar antenna and/or marine antennas and which may be tilted to a lowered position for clearing low obstructions.

For a long time, marine radio systems have been in wide use on pleasure craft type boats such as cabin cruisers and like water craft having superstructures which extend above the normal deck level. The antennas for such marine radios are usually in the form of elongated antenna devices of considerable height which, if provision is not made to lower or depress them in some manner, create problems when the boat passes under low obstructions such as bridges or into docking bays of boat houses and the like. Commonly the elongated whiplike marine radio antennas can be made sufficiently movable by providing flexible springlike mounts or some kind of pivotal connection at their lower mounted ends to retract them from their normal elevated positions. Marine radar systems have now become more widely used for private pleasure watercraft such as cabin cruisers and the like, and typically involve a rotary radiation beam emitting and receiving antenna element and mounting structure, for the common PPI type radar unit display, which is a relatively rigid structure and projects usually several feet above the mounting base for the radar antenna. Clearly such structures may create considerable problems in providing sufficient clearance in the upper part of the boat or watercraft to pass under low obstructions.

An object of the present invention is the provision of a novel upwardly extending generally bridge type supporting structure for a radar antenna and/or marine radio antennas and the like to be mounted in upwardly extending relation on a boat superstructure such as a cabin cruiser roof (the bridge structure being hereinafter referred to as a supporting arch), wherein the supporting arch is mounted by a tilting base mounting assembly at the lower ends of downwardly extending legs thereof operable under remote control by power means to swing the arch between a normal raised position for normal operation of the antennas to a lowered position to permit clearance of the antennas under low obstructions with which they would normally collide.

Another object of the present invention is the provision of a supporting arch mechanism for radar and other electronic equipment antennas and the like as described in the immediately preceding paragraph, wherein box-like mounting assemblies are provided at the base of each of the legs of the arch structure for pivotal support of the arch between the lowered and raised positions, and wherein at least one of the box-like mounting structures includes a hydraulic actuator cylinder operative from a toggle switch and connected to a suitable actuator projection extending from the adjacent arch leg eccentrically of the pivot axis for the arch leg to move the same between raised and lowered positions.

Yet another object of the present invention is the provision of a supporting arch mechanism for boats or the like as described in the two immediately preceding paragraphs, wherein gusset structure is provided in the box-like mounting base structure to withstand the internal stresses produced by the hydraulic actuator cylinder, and wherein a locking device may be provided for providing a positive locking of the arch structure in the raised or "full up" position.

Yet another object of the invention is the provision of a supporting arch assembly for boat antennas and the like as described in the immediately preceding paragraphs, wherein access openings are provided in top cover portions of the box-like mounting base structures communicating with the hollow interior of the legs of the arch and removably covered by a removable closure panel, to provide access for storing material inside the arch leg.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 6 is a fragmentary perspective view illustrating a portion of a leg of the radar arch in lowered position and showing the structure providing the closable access openings to the legs of the radar arch for storage use; and FIG. 7 is a hydraulic schematic diagram showing the hydraulic circuitry for activating the radar arch to move it to the raised and lowered positions, and

DETAILED DESCRIPTION OF A PREFERRED EMBODIMENT

Figure 1:
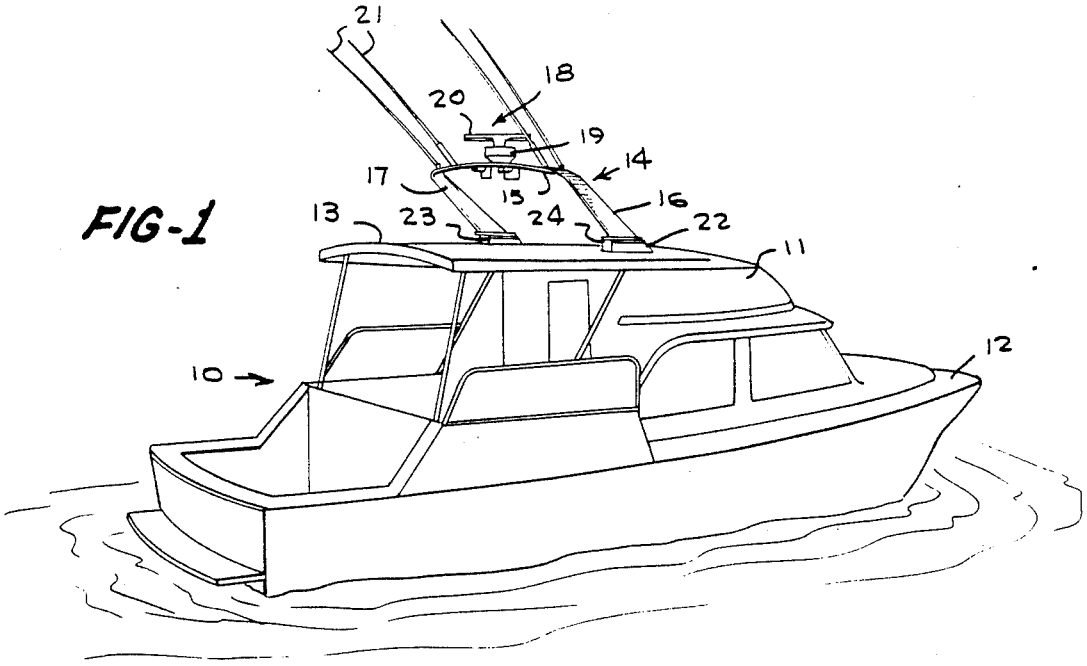
FIG. 1 is a perspective view of a typical cabin cruiser type private pleasure boat having a tiltable radar arch assembly of the present invention.

Referring to the drawings, wherein like referenced characters designate corresponding parts throughout the several figures, the present invention is designed to be incorporated on a watercraft or boat 10, for example a cabin cruiser or the like of the general type illustrated in FIG. 1, having a cabin or superstructure 11 extending above the main deck 12, covered by a rigid roof structure 13. The apparatus of the present invention is generally described as a radar arch assembly 14, in the form of a generally inverted U-shaped bridge or arch configuration, having a transverse top bridge portion 15 and depending legs 16, 17, which the illustrated embodiment are formed of a hollow, somewhat streamlined hollow metallic structure of considerably greater fore-and-aft length than the transverse width through the leg or bridge portions, and with the legs 16, 17 raked at a stylish rake angle. The radar antenna unit to be supported by this arch assembly 14 is indicated generally by the reference character 18, and comprises a motor housing pedestal component 19 fixed substantially in the midregion transversely and fore-and-aft on the top bridge portion 15 with the rotatable antenna element 20 surmounted above and rotatable about a vertical axis relative to the pedestal component 19. Also, as shown, a plurality of elongated, generally whiplike elongated marine radio antennas 21 may also be carried by the top bridge portion of the arch assembly 14 in laterally flanking relation to the radar antenna unit 18.

The lower end portions of both legs 16, 17 of the arch assembly 14 are mounted on the super-structure roof 13 by generally box-like arch mounting housing assemblies 22, 23, one associated respectively with each of the legs 16, 17. The physical structure of the mounting housing assemblies 22, 23 are substantially the same and each comprise a lower base mounting component 24 to be fixed to the roof 13 and a top cover component 25 fixed to and forming the foot of the associated leg 16, 17 of the arch assembly.

The lower base mounting component 24 forms generally a structurally strong open ended, rigid upwardly opening box-like base comprising a bottom plate member 26, a pair of upright sidewalls 27, 28 and a front end wall 29 welded to the bottom plate member 26 and at its juncture with the adjacent vertical side and end wall members to such members at interior corners of the junctures. The opposite end 30 forming the pivot end of the base mounting component 24 is formed of a U-shaped yoke 30Y formed of bottom wall portion **30*a* and vertical sidewall portions 30*b* and 30*c* welded together and to adjoining portions of upright and bottom portions of the box-like base 24. The upper end portions of the upright leg formations 30*b*, 30*c* and corresponding portions of the upper forwardmost corners of the sidewalls 27, 28 are provided with registering through openings 31*a*, 31*b* which, in the illustrated embodiment, receive bronze oil impregnated bearing sleeves 32*a*, 32*b* and a cylindrical pivot pin or main hinge pin 33 secured therein at outwardly projecting end portions thereof by snap rings 34** and backing washers.

At the opposite end of the box-like base mounting component 24 near the front end wall 29 thereof are a pair of vertically spaced gusset plates 35 in each of the two opposite corners to rigidify the base mounting component adjacent the end wall 29 to withstand the interval stresses produced by actuator cylinders to be housed in the base 24. A series of openings 36 in the bottom plate 26 for threaded fasteners such as bolts or the like are provided in longitudinally aligned relation inwardly adjacent the side walls 27, 28, including a pair of such openings 36 in the lowermost gusset plates 35 and a pair of such openings 36 in the forwardly protruding portion of the bottom plate 26 extending rearwardly beyond the end where the yoke formation 30Y and pivot pin 33 are located. Also, large openings 37 lined by cylindrical tubular sleeve liners **37*a* are provided in the bottom plate 26** for passage of electric wiring and hydraulic conduits therethrough.

The cover forming top component 25 is in the form of a planiform rigid metal plate having longitudinal and transverse dimensions corresponding substantially, in the illustrated embodiment, to the length and transverse width of the box shaped portion of the base component 24, although slightly longer than the later, having two thick triangular knuckle formations 40 welded thereto and extending downwardly therefrom in the closed position of the top component 25, also provided with through cylindrical openings **38*a* lined with bronze oil impregnated bearings 39 in the illustrated embodiment to also receive the pivot pin 33 therethrough pivotally linking the top component 25 to the base mounting component 24. Eccentrically spaced from the axis of the openings 38*a* in the triangular knuckle members 38 for the pivot pin 33 are another pair of oil impregnated bronze bearing lined openings 40', lined by bearings 41 for receiving a cylinder rod end pin 42 extending through the end coupling formation 43 on the end of cylinder rod 44 reciprocating in a hydraulic cylinder 45 housed within the cavity defined by the box-like base mounting component 24. The opposite end of the hydraulic cylinder 45 is pivotly linked by pin 46 extending through clevis 47 to a mounting member 47*a* fixed by suitable threaded fasteners 47' to the front end wall 29 of the base mounting component 24. The uppermost portion of the end wall 29 of the lower base mounting component 24 includes an upwardly projecting extension 29' which extends above the uppermost edges of the sidewalls 27, 28 by a distance equal to the thickness of the top plate 25*a* of the cover forming top component 25 and terminates in vertical alignment with the planes of the inwardly facing surfaces of the sidewalls 27, 28, to interfit in nested relation into a well or cavity formed in the free end portion of the top plate member 25*a* sized appropriately to receive the upwardly projecting extension 29' therein. A through hole 25'' is formed in both of the ear formations 25' laterally flanking the cavity or well and a through hole 29'' of the same diameter coaxially aligned with the holes 25'' extends through the upwardly projecting extension 29' of the end wall 29, to receive, when they are in registry with each other, a locking pin 48 , for example about ⅜th inch in diameter, of sufficient length to extend through the registered holes 25'' and 29'', and which for convenience is secured against accidental loss by a flexible cable or the like 48'. The lower ends of the legs 16, 17 of the radar arch assembly 14 are provided with integral outwardly projecting flange formations at the front, rear and both sides of each leg defining a rectangular foot 49 of the same length and width dimensions as the top plate 25*a* of the cover forming top component 25, the foot being rigidly secured to the top plate member 25*a* by a plurality of threaded fasteners or similar fastening devices, as indicated at 49'. Thus, upon tilting movement of the cover forming top component 25 about the pivot pin 33, the radar arch similarly tilts about the axis of the pivot pin from the upright position shown in FIG. 1 to the retracted or lowered position wherein the rearmost edges of the leg 16, 17 and the top bridge portion 15 are in a plane substantially parallel to the plane of the top surface of the roof 13. For cosmetic purposes, a decorative shroud of generally triangular configuration in side elevation may be added at the front, with its forwardly facing surface angled to match the rake angle of the radar arch legs, and a cover plate or cover structure of any desired type may be placed inside the top of each base section 24 to cover the cylinders 45 and hose and fitting members incorporated in the base component 24**.

Tilting of the arch is accomplished by two actuator assemblies which fit under each foot or leg 16, 17 of the radar arch 14, the arch tilting mechanism including the mounting housing assemblies 22, 23 having the tiltable cover forming top component 25 attached to the foot of the radar arch formed by the flange formations at the lower ends of the legs 16, 17 while the lower base mounting component 24 is fixed by threaded fasteners to the roof of the cabin or boat superstructure as previously described. Wires from the radar and marine radio antennas pass through the hollow top bridge and depending leg portions of the arch itself and through wiring holes in the top and base components 25 and 24 of the mounting assemblies 22, 23 and on into the electronic equipment.

While the power means for driving the actuator assemblies in the specifically described embodiment are a hydraulic power system powered by a commercially available electric motor driven pump/reservoir/-solenoid valve system mounted within the boat, whereby outward and inward movement of the cylinder rod 44 relative to the piston 45 shifts the cover forming top member 25 and the attached radar arch about the axis of the pivot pin 33, it will be appreciated that other types of power drive mechanisms may be employed, such as an electric motor system driving a conventional rotatable worm and worm gear, or driving a gear and reciprocative rack mechanism, or similar reciprocating electricly driven mechanisms, coupled to the eccentric pin 42 to rotate the cover forming top component 25 and the attached radar arch about the axis of the pivot pin 33.

In the illustrated embodiment, wherein a hydraulic cylinder mechanism is employed in each of the mounting assemblies 22, 23, as indicated by the hydraulic cylinder 45 and cylinder rod 44 in each mounting assembly, the hydraulic cylinders 45 are intercoupled in the hydraulic system schematically illustrated in FIG. 7 by fittings and hoses extending between the cylinders 45 and the pump and reservoir components shown in FIG. 7, as an example, and wherein a solenoid valve or the like forming the main control valve for the hydraulic system is electrically controlled by a toggle switch 50 which is preferably a two pole, three position toggle switch, for example a 2L1-7 toggle switch of the type produced by the MICRO SWITCH Division of Honeywell Inc. having an off center position, and two key way positions wherein the toggle member is pressed forwardly or rearwardly from the center position, connected to the control valve, indicated at 51 to switch it to positions causing the cylinders 45 to move in forward or reverse positions.

Figure 2:
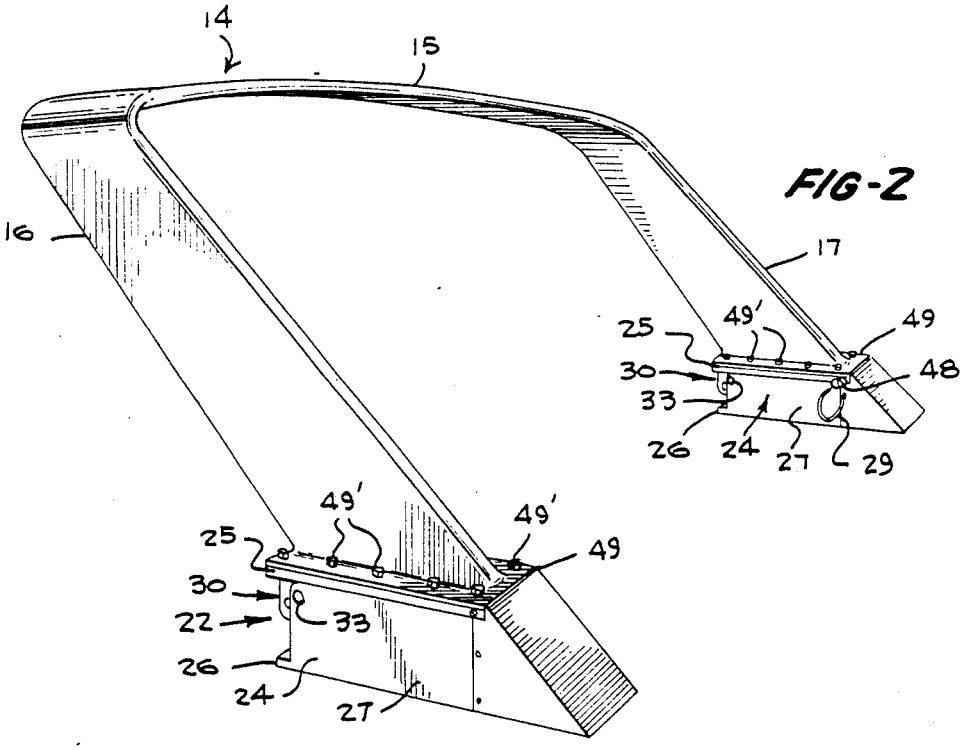
FIG. 2 is a perspective view of the radar arch assembly showing a typical radar antenna and portions of marine radio antennas mounted thereon.
Figure 3:
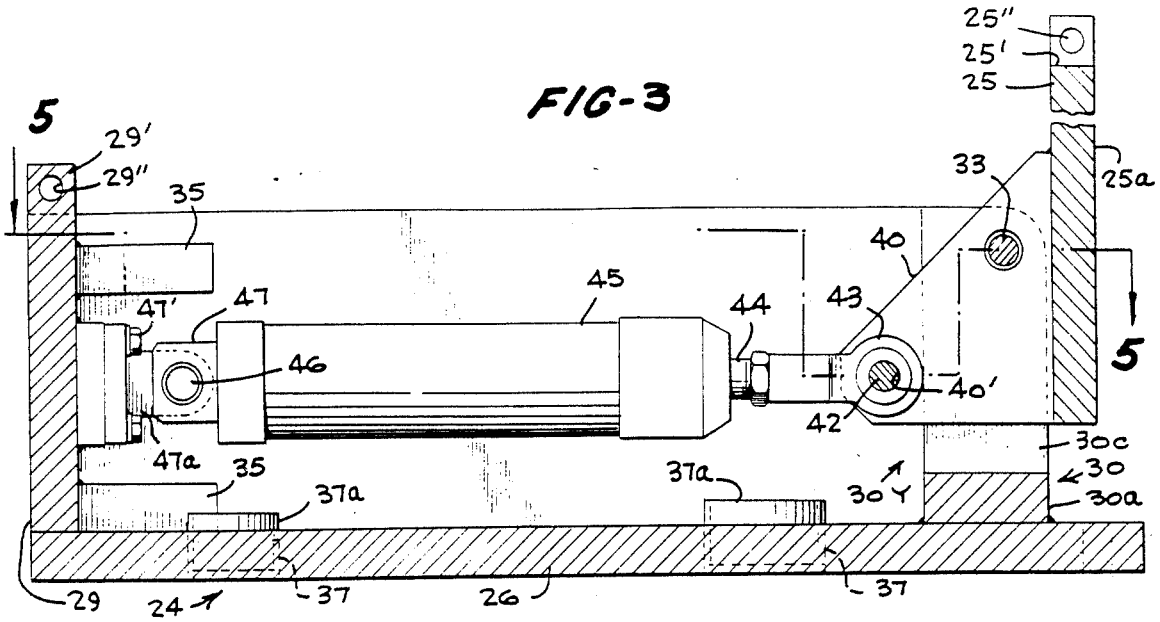
FIG. 3 is a vertical longitudinal section view of one of the box-like mounting assemblies and adjoining portions of the leg of the radar arch, with the arch in lowered position.
Figure 4:
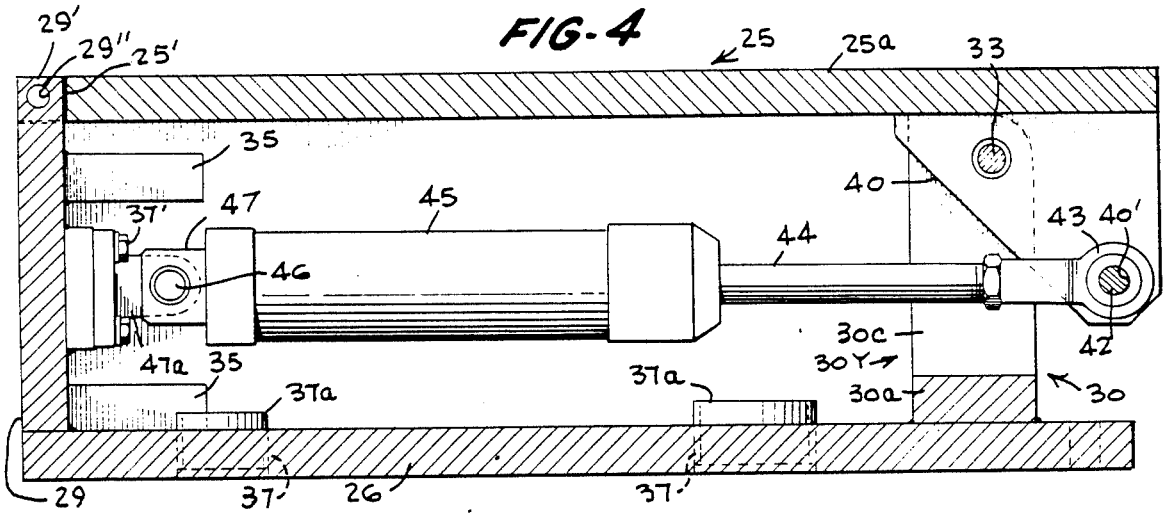
FIG. 4 is a vertical longitudinal section view of one of the box-like radar arch mounting assemblies, with the radar arch in the raised position.
Figure 5:
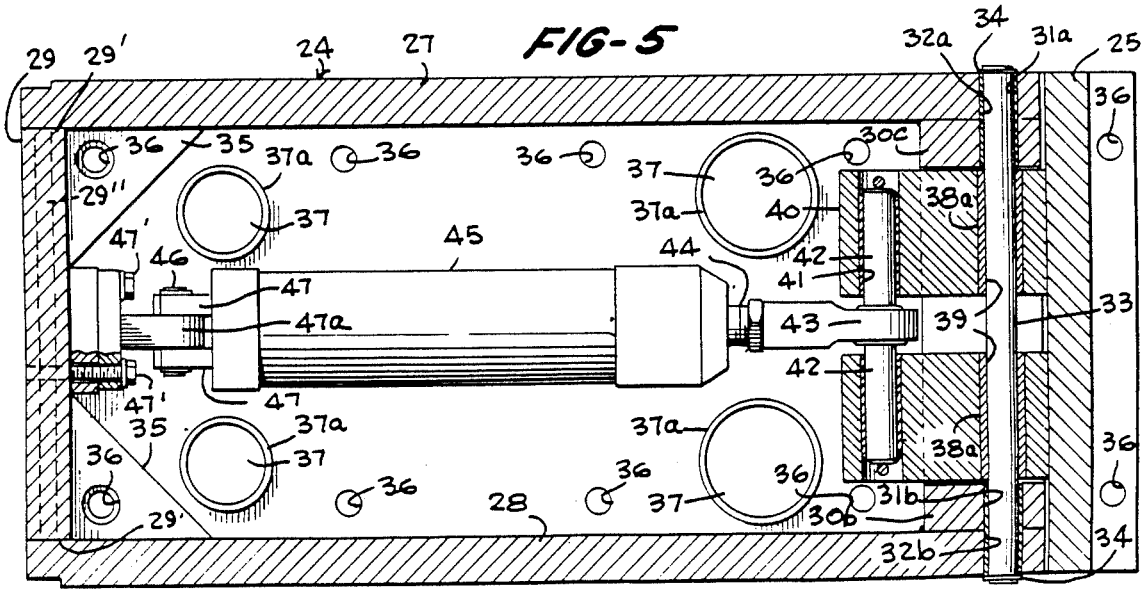
FIG. 5 is a horizontal sectional view taken along the line 5—5 of FIG. 3.

The system is designed to have the radar arch 14 normally in the raised position illustrated in FIGS. 1 and 2, wherein the cover forming top component 25 of the mounting housing assemblies 22, 23 is closed to the horizontal position against the confronting edges of the side walls of the base mounting component 24, and is releasably locked in that raised position of the radar arch by the locking pin 48 inserted in the holes 25" and 29" of the ear formations 25' and end wall extension 29' of the mounting assemblies 22, 23. The electric/hydraulic system incorporated in the tiltable arch mounting assembly of the present invention is designed to allow the arch and all its antennas to be lowered by tilting the entire radar arch assembly rearwardly from the mounting assemblies 22, 23 to allow the boat to pass under low obstructions which would normally collide with the antennas or the arch itself. First, the safety locking mechanism provided by the locking pin 48 and holes 25",29" is disengaged by withdrawing the locking pin 48 from the holes, and the three position toggle switch 50 is activated to momentarily engage appropriate contacts of the toggle switch by moving the toggle member to the "lower" position, which causes the arch assembly to then tilt rearwardly, for example up to a maximum angle of 90° from vertical, and which can be stopped at any position between full up and full down position by releasing the switch. By moving the toggle member to the "lower" position, the solenoid valve 51 is activated to open the work port to the reservoir, and since, in the illustrated embodiment, the actuator cylinders 45 are of a single acting type, with a conventional breather filter in the rod-end port, atmosphere is allowed to intake and exhaust with cylinder movement, and the weight and location of the radar arch causes it to fall by gravity when the toggle switch is in this lower position, it fall being restrained by the throttling effect of a conventional flow restricter as the cylinders 45 allow the arch to descent. Releasing of the toggle switch 50 moves the control valve 51 to block the activation port and stop all motion.

When it is desired to raise the arch, the toggle of the control switch 50 is moved to the raised position, which simultaneously opens the control valve port of control valve 51 to oil flow and operates the motor pump unit, filling the cylinders 45 and causing the cylinder rods to move or extend, and thus pivoting the arch assembly upward to the raised position. In the fully raised position, the locking pin 48 of the safety fastening device is inserted in the registered holes 25" and 29" thus providing a rigid mounting for resistance to stresses attempting to move the arch assembly while the vessel is under way.

We claim:

1. A tiltable upwardly extending supporting arch assembly for supporting a radar antenna above the roof of a cabin or control bridge superstructure of a boat comprising a unitary rigid arch member of inverted substantially U-shaped configuration including a generally horizontal top portion transversely spanning a major portion of the width of the roof and a pair of depending leg portions extending downwardly from opposite ends of the top portion having feet at their lower ends for attachment to mounting assemblies, a pair of tilting base mounting assemblies at the lower ends of said leg portions each having a box-like base housing component in the shape of an elongated box shaped housing to be fixed to the roof and having side members and a tiltable top plate member for attachment to the arch member feet pivotally coupled to said side walls of said box-shaped housing by a pivot pin for angular movement about the pivot pin from a first position disposing the arch member in a raised normal operating position to a second position disposing the arch member in a lowered position wherein the leg portions lie substantially parallel to confronting surface portions of the roof, powered actuator means contained in said box-shaped housing having a movable drive member coupled to said top plate member eccentrically of said pivot pin for drawing the top plate member and arch member attached thereto between said first and second position, and remote control means including a three-position toggle switch coupled to said actuator means to condition the actuator means at first and second position of said switch for movement of the top plate member of each mounting assembly to said first and second positions and to deactivate the actuator means at a third position of said switch.

2. A tiltable arch assembly as defined in claim 1, wherein said top plate member is substantially coextensive longitudinally and transversely with the base housing component forming a top closure for the latter and includes a downwardly extending knuckle formation having a first hole for said pivot pin and a second formation eccentrically spaced from said first hole to couple the knuckle formation in driven relation with said movable drive member.

3. A tiltable arch assembly as defined in claim 2, wherein the leg portions of said arch member are hollow along at least the lower end portions, and said top plate member has an access opening therethrough registering with the hollow interior of said leg portions for introduction and withdrawal of articles to be stored in said hollow interior, and said top plate member including a closure panel movably supported thereon for covering and exposing said access opening.

4. A tiltable arch assembly as defined in claim 1, wherein said base housing component has a pair of side walls joined to a bottom plate and an end wall defining an upwardly opening box-like housing open at one end, said pivot pin being journaled in alined openings in upper corner portions of the side walls located adjacent the open end of the box-like housing for accommodating movement of portions of said top plate member coupled to said drive member into said open end.

5. A tiltable arch assembly as defined in claim 2, wherein said base housing component has a pair of side walls joined to a bottom plate and an end wall defining an upwardly opening box-like housing open at one end, said pivot pin being journaled in alined openings in upper corner portions of the side walls located adjacent the open end of the box-like housing for accommodating movement of portions of said knuckle formation into said open end.

6. A tiltable arch assembly as defined in claim 9, wherein the leg portions of said arch member are hollow along at least the lower end portions, and said top plate member has an access opening therethrough registering with the hollow interior of said leg portions for introduction and withdrawal of articles to be stored in said hollow interior, and said top plate member including a closure panel movably supported thereon for covering and exposing said access opening.

7. A tiltable arch assembly as defined in claim 1 wherein said powered actuator means is a hydraulic cylinder and reciprocative cylinder rod unit having one end coupled to said top plate member and the other end coupled to a wall of said box-like base housing component.

8. A tiltable arch assembly as defined in claim 2 wherein said powered actuator means is a hydraulic cylinder and reciprocative cylinder rod unit having one end coupled to said top plate member and the other end coupled to a wall of said box-like base housing component.

9. A tiltable arch assembly as defined in claim 4 wherein said powered actuator means is a hydraulic cylinder and reciprocative cylinder rod unit having one end coupled to said knuckle formation and the other end coupled to a wall of said box-like base housing component.

10. A tiltable arch assembly as defined in claim 5 wherein said powered actuator means is a hydraulic cylinder and reciprocative cylinder rod unit having one end coupled to said knuckle formation and the other end coupled to a wall of said box-like base housing component.

11. A tiltable arch assembly as defined in claim 9, wherein the leg portions of said arch member are hollow along at least the lower end portions, and said top plate member has an access opening therethrough registering with the hollow interior of said leg portions for introduction and withdrawal of articles to be stored in said hollow interior, and said top plate member including a closure panel movable supported thereon for covering and exposing said access opening.

12. A tiltable arch assembly as defined in claim 7, wherein said powered actuator means includes an electric motor driven hydraulic fluid pump and reservoir and control valve circuit connected to said toggle switch to activate the electric motor driven pump and control valve when said switch is in said first or second positions for movement of the hydraulic cylinder and rod unit and arch member to raised and lowered positions.

13. A tiltable arch assembly as defined in claim 9, wherein said powered actuator means includes an electric motor driven hydraulic fluid pump and reservoir and control valve circuit connected to said toggle switch to activate the electric motor driven pump and control valve when said switch is in said first or second positions for movement of the hydraulic cylinder and rod unit and arch member to raised and lowered positions.

14. A tiltable arch assembly as defined in claim 8, wherein said powered actuator means includes an electric motor driven hydraulic fluid pump and reservoir and control valve circuit connected to said toggle switch to activate the electric motor driven pump and control valve when said switch is in said first or second positions for movement of the hydraulic cylinder and rod unit and arch member to raised and lowered positions.

15. A tiltable arch assembly as defined in claim 1, wherein the leg portions of said arch member are hollow along at least the lower end portions, and said top plate member has an access opening therethrough registering with the hollow interior of said leg portions for introduction and withdrawal of articles to be stored in said hollow interior, and said top plate member including a closure panel movably supported thereon for covering and exposing said access opening.

* * * * *